US005503856A

United States Patent [19]

Hustad et al.

[11] Patent Number: 5,503,856

[45] Date of Patent: Apr. 2, 1996

[54] MULTIPLE PORTION RECLOSEABLE PACKAGE

[75] Inventors: Gerald O. Hustad, McFarland; Timothy G. Mally, Oregon, both of Wis.

[73] Assignee: Oscar Mayer Foods Corporation, Madison, Wis.

[21] Appl. No.: 731,284

[22] Filed: Jul. 16, 1991

Related U.S. Application Data

[63] Continuation of Ser. No. 511,678, Apr. 20, 1990, abandoned.

[51] Int. Cl.[6] ..... B65D 65/00

[52] U.S. Cl. ..... 426/108; 383/5; 383/65; 383/93; 426/121; 426/122

[58] Field of Search ..... 426/87, 121, 122, 426/123, 126, 127; 206/610, 632; 383/61, 63, 65, 5, 93

[56] References Cited

U.S. PATENT DOCUMENTS

| | | | |
|---|---|---|---|
| 2,596,514 | 5/1952 | Uehlein | 426/121 |
| 2,911,306 | 11/1959 | Griem | 426/121 |
| 3,145,112 | 8/1964 | Boegershausen . | |
| 3,162,539 | 12/1964 | Repko | 426/122 |
| 3,490,576 | 1/1970 | Alessi et al. . | |
| 4,246,288 | 1/1981 | Sanborn, Jr. | 383/63 |
| 4,437, 293 | 3/1984 | Sanborn, Jr. | 53/412 |
| 4,528,224 | 7/1985 | Ausnit | 383/63 |
| 4,731,911 | 3/1988 | Gould | 383/63 |
| 4,744,674 | 5/1988 | Nocek | 383/61 |
| 4,923,309 | 5/1990 | Van Erden | 383/61 |
| 4,925,316 | 5/1990 | Van Erdan et al. | 383/61 |
| 4,944,603 | 7/1990 | Cornish et al. | 426/129 |

OTHER PUBLICATIONS

Modern Packaging, Nov. 1959, "Bacon in a strippable, seven-layer 'booklet'" p. 145.

*Primary Examiner*—Anthony Weier

*Attorney, Agent, or Firm*—Lockwood, Alex, Fitzgibbon & Cummings

[57] ABSTRACT

A recloseable package has discrete, multiple product portion enclosures between first and second package films. Each product portion enclosure is separated from its adjacent product portion enclosure by a package central web portion. A recloseable seal is provided on the central web portion for each multiple product portion enclosure, and the product is hermetically sealed in its portion enclosure by a hermetic seal extending around the periphery thereof and interior of each recloseable seal.

6 Claims, 2 Drawing Sheets

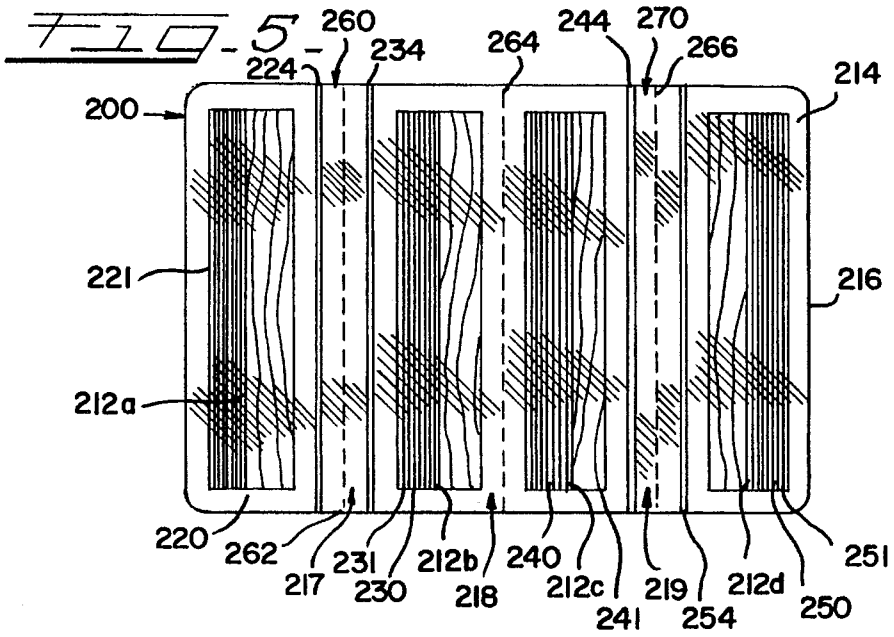
FIG. 5
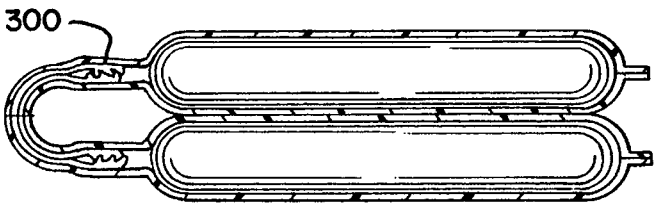
FIG. 7
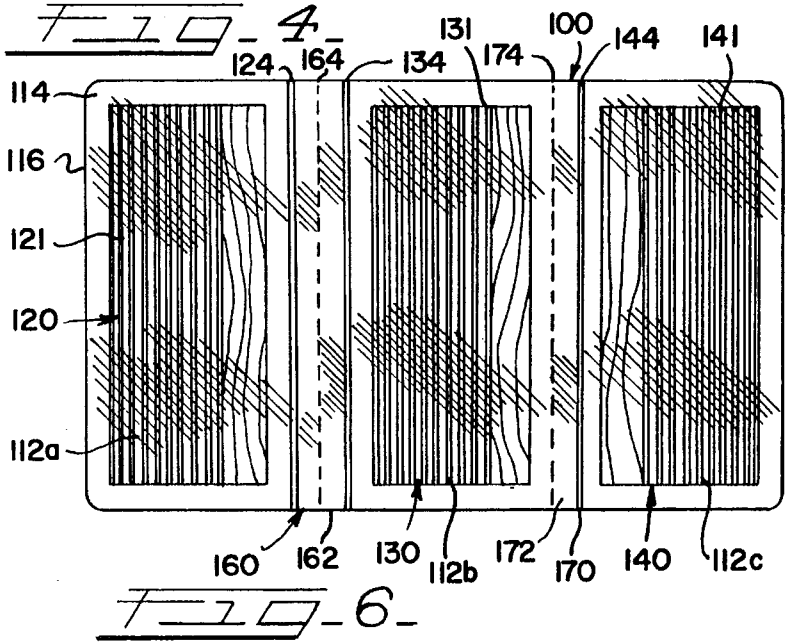
FIG. 4
FIG. 6
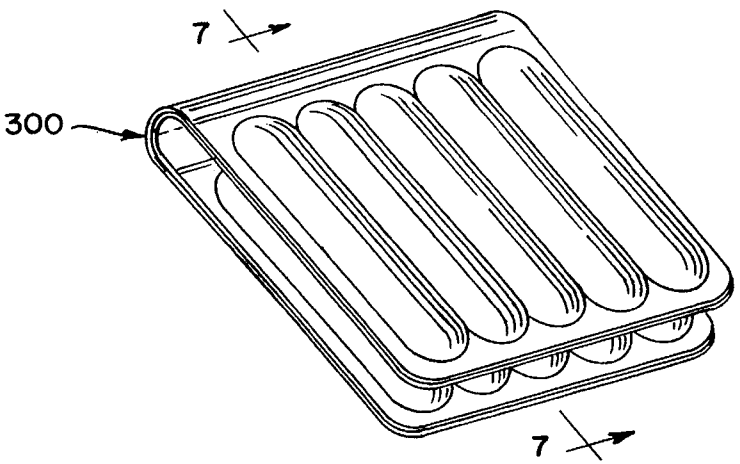

MULTIPLE PORTION RECLOSEABLE PACKAGE

This application is a continuation of application Ser. No. 511,678, filed Apr. 20, 1990 now abandoned.

BACKGROUND AND SUMMARY OF THE PRESENT INVENTION

The present invention relates generally to recloseable packages for hermetically sealing consumable products between generally opposing package side panels, and more particularly to recloseable packages for food products and the like in which the package has multiple, separately recloseable product portions.

Certain processed meats and/or food products sold to consumers are sold in packages in which the processed meats or food products are mounted on a backing board. The freshness of these food products such as bacon, sliced luncheon meats, cheeses and the like contained within these packages depends upon the extent to which the package is vacuum packed or gas flushed and subsequently hermetically sealed. Often, the purchaser does not use the entire amount of food product contained within such packages at once, but rather uses each food product over an extended period of time. Often, the purchaser freezes the initial package purchased and thaws it when it is needed. If the initial package contains more product than that which cannot be completely consumed in one sitting, the purchaser must often repack the food product in separate, portion-sized different recloseable containers. Accordingly, a need exists for an improved food product package of the type having multiple, easily separable product portion cavities, where each of the product cavities has its own separate recloseable seal.

The improved packages of the present invention provide significant advantages in that each product portion has its own hermetic seal and recloseable seal so that each individual product portion cavity is liquid tight and suitable retains within the cavity, fluids of the products contained therein, including water, juices, oils and the like. Each individual product cavity can be selectively accessed through its individual recloseable seal. A hermetic seal disposed around each product cavity and interior of each recloseable seal has an easy open or "peel " seal portion located adjacent to the product, Each recloseable seal is opened with digital pull-apart forces which are also used to open the peel seal. The peripheral hermetic seal can maintain a vacuum pressurized and/or gas-flushed environment within the package. A "zipper" seal consisting of interengaging components such as rib and groove fastener elements is the preferred recloseable seal means.

One or more central web portions of the package effectively separate the individual product cavities from each other, and each web portion preferably contains a line of weakening which enables a user to easily separate and store individual product cavities.

The recloseable seals associated with each of the multiple product portion cavities are attached to confronting faces of the packaging films. Interengaging fastener elements are provided in pairs having a central interconnecting web and are adhered directly to the opposing package film sheets. Each interengaging fastener element pair is permanently anchored to the opposing package panels and is sealed at the opposite ends thereof, which decreases the possibility that the package films may tear or separate either when the individual product cavities are separated from the package or when one of the product cavities is accessed. The central web portions of the package which separate the product portions preferably also have a tamper evident feature in that the central web portions are provided with one or more lines of weakening extending therein which must be broken for the user to obtain access to the individual product compartment recloseable seals.

Accordingly, it is a general object of the present invention to provide an improved recloseable package for use with products and which has multiple, individually sealed product cavities, each such product cavity having its own recloseable seal.

Another object of the present invention is to provide a recloseable, multi-compartment package for food products and the like having a separate recloseable seal associated with each food product compartment, the multiple compartments being joined by a package central web portion having a line of weakening associated therewith which enables easy separation of the compartments and access thereto.

Yet another object of the present invention is to provide a package having separate product portions sealed within the package, each of the individual product portions having an individual recloseable seal and an individual hermetic seal associated therewith.

A further object of the present invention is to provide a product package having distinct product packs, each product pack having a recloseable seal associated therewith, each product compartment having a tamper evident extension associated therewith.

Still another object of the present invention is to provide an improved food product package having multiple individual food product compartments, recloseable seals exterior of the food products and hermetic seals interior of the recloseable seal, the multiple food product compartments being foldably connected by associated package web portions so as to provide a multi-component stack of food-filled compartments separated by a web portion folded onto itself.

These and other objects of the present invention will become more readily apparent from a reading of the following detailed description.

BRIEF DESCRIPTION OF THE DRAWINGS

FIG. 4 is a plan view of an alternate embodiment of a package incorporating the principles of the present invention and having three individual product enclosures;

FIG. 5 is a plan view of another alternate embodiment of a package incorporating the principles of the present invention and having four individual product enclosures;

FIG. 6 is a perspective view of another alternate embodiment of a package incorporating the principles of the present invention containing two frankfurter portions; and FIG. 7 is a cross sectional view of the package of FIG. 6 taken along line 7—7.

DETAILED DESCRIPTION OF THE PREFERRED EMBODIMENTS

Figure 1:
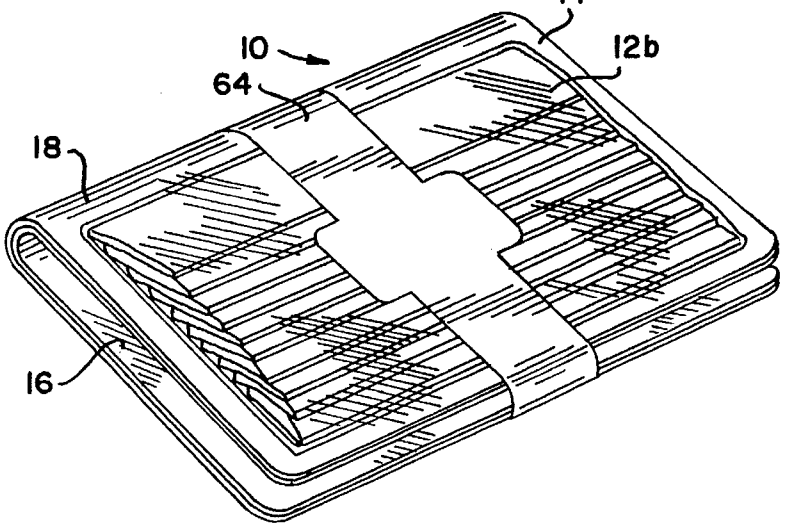
FIG. 1 is a perspective view of a package incorporating the principles of the present invention. For purposes of illustration only, the package is shown as containing vacuum-packed bacon slices.

FIG. 1 illustrates an embodiment of a recloseable, multiple compartment package 10 constructed in accordance with the principles of the present invention. The package 10 of the present invention is particularly suitable for sealing two distinct portions of a perishable food product, shown in FIGS. 1–3 as bacon slices 12*a*, 12*b*, between a first package film sheet or web 14 and a second package film sheet or web 16. The first and second package webs 14 and 16 which form the two sidewalls of the package 10 can be made from a variety of materials including plastic films, plastic films with heat sealable coatings, multi-layered laminates and/or co-extrusions and the like. A preferred plastic film for assembly of the packages of the present invention is one which is substantially impervious to air, oxygen and/or moisture.

When one or more of the package webs 14, 16 is formed from a multi-layered construction, it is desirable to use a thin, inner layer which is substantially impervious to air, oxygen and/or moisture in combination with an outer layer having sufficient flexibility [illegible] desirable structural characteristics so that the l[illegible] function as a package sidewall film. For[illegible]ion and discussion, the package p[illegible]eets will be shown as a single, l[illegible]ual practice, each flexible packa[illegible]y be a co-extrusion and/or laminate of tw[illegible]e layers which will provide sufficient protection to the product (e.g., oxygen and moisture barriers) and which can form a hermetic, and if desired, peelable seal at the inner surfaces. As is known in the art, multi-layered films comprised of copolyester films or sheets, vinylidene chloride polymers or sheets such as "Saran", ethylene vinyl acetate, "Surlyn" ionomer resin or polyethylene plastic films or sheets are suitable.

Each bacon portion 12*a*, 12*b* of the package 10 is contained within its own separate product cavity or compartment 20 and 30. The bacon compartments 20, 30 are initially defined by and separated from each other by a central web portion 18 which is integral with the bottom film sheet 16. The bacon portions 12*a*, 12*b* are desirably positioned on the bottom film sheet 16 within two preselected bacon support areas 21, 31 contained within respective portion margins 25, 35. Each of the individual bacon portions 12*a*, 12*b* may be deposited on a carrier (not shown) such as a sheet of parchment paper or plastic prior to placement on the bottom film sheet 16. Although the two bacon portions 12*a*, 12*b* of the package 10 shown are illustrated as being of approximately equal size, it will be appreciated that the multiple product portions of the packages of the present invention may also contain unequal amounts of product.

A plastic film sheet which is either flexible or semi-rigid and which has a sufficient thickness to withstand the package assembly process is preferably used as the bottom film sheet 16. A relatively rigid thermoplastic sheet may also be used provided that the board is approximately configured so that it can be folded in its web portion(s). The top and bottom film sheets 14 and 16 are combined, after attachment of a recloseable seal assembly 40 (described in greater detail below), by contacting each other around the bacon portions 12*a*, 12*b* for each separate product compartment 20 and 30. When a vacuum is applied to the space between the top film sheet 14 and the bacon, the top film sheet 14 is drawn inwardly about the bacon 12*a*, 12*b* to conform to the contour thereof to provide the package 10 with the desired rigidity for withstanding vigorous handling during transport and retail display and the like.

Figure 2:
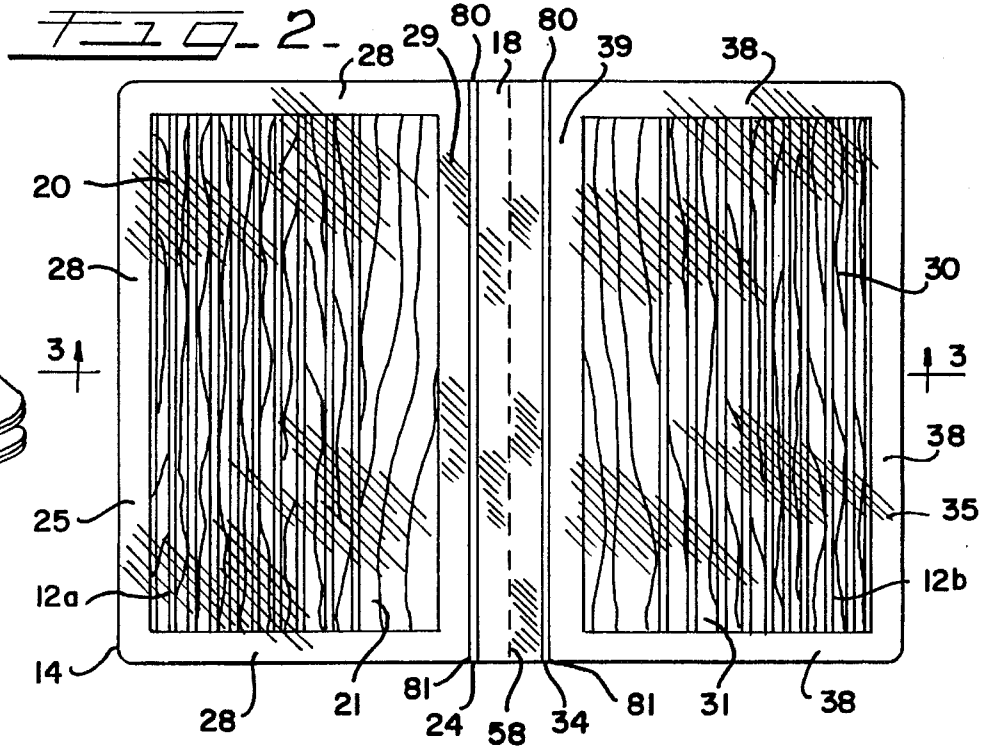
FIG. 2 is a plan view of the package of FIG. 1, taken in an unfolded state.
Figure 3:
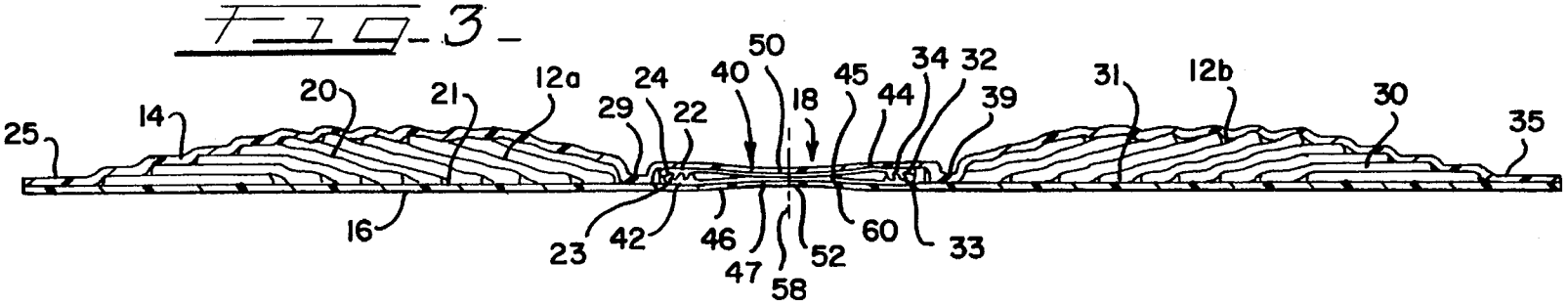
FIG. 3 is a cross sectional view of the package of FIG. 2 taken along line 3—3.

Referring specifically to FIGS. 2 and 3, the package 10 has a recloseable seal assembly 40 secured to the central web portion 18 thereof, which is illustrated as a double interengaging fastener assembly 42. The interengaging fastener assembly 42 includes a top male or rib double closure member 44 which has two distinct rib strips 22, 32 interconnected by a central web 45 and a bottom female or groove double closure member 46 which has two distinct groove strips 23, 33 interconnected by a central web 47. Although the interengaging fastener assembly 42 is illustrated as one that is particularly secure for the illustrated type of package 10, namely, having two lengths of a formed double rib strips 22, 32 and similar lengths of formed double groove strips 23, 33, it will be noted that the rib and groove strips of the recloseable seal assembly 40 are not limited to any particular number of interengaging fastener elements and can be made with one rib and one groove. The main criteria of the rib and groove strips are that the ribs project outwardly a sufficient distance to be securely engaged with and held by their confronting and complementary counterparts 23, 33 in the groove member 46 yet readily separable by the fingers of the purchaser. Both the rib and groove strips of the interengaging fastener assembly 42 can take any number of various characteristics and configuration in addition to those described herein. In addition to the double rib and groove closure assembly described above, a single rib and groove closure assembly can be used and applied to the package films 14, 16 at the central web portion 18 thereof to effect the desired recloseable seals 24, 34. The recloseable seal assembly 40 can be easily attached to the film sheets 14 and 16 in an interengaged fashion. In this regard, the respective rear surfaces of the rib and groove members 44 and 46 serve as attachment flanges 50, 52 which are adhered to the confronting faces of the top and bottom film sheets 16 and 16 during assembly. The recloseable seal rib and groove members may be attached to the film sheets by any suitable means such as adhesive sealing or heat sealing. Preferably, the interengaging fastener assembly is applied as a unit to the bottom film sheet 16 in the form of a continuous strip and trimmed to match the width of the bottom film sheet 16. The separate rib and groove strips of the interengaged rib and groove members 44 and 46 are permanently attached together at the ends of the package recloseable seals 24 and 34 so that the fastener material is not wasted in the trimming of the package and so that when the recloseable seal is opened, the purchaser cannot disrupt the integrity of the hermetic seals 28, 38 of the two product compartments 20 and 30 of the package 10. Although the recloseable seal assembly is illustrated as having two separate rib and groove closure members 44 and 46, the fastener elements may also be formed integral with the opposing package film sheets 14 and 16, such as by extrusion. In such an instance, the extrusion die may be used to thin the central webs 45, 47 of the interengaging fastener elements to enable the package to be more easily folded between the separate product compartments.

After the interengaging fastener assembly 42 is fitted onto the bottom film sheet 16 and the ends 80, 81 thereof are attached together, the two bacon portions 12*a*, 12*b* are positioned on the respective product compartment product areas 21 and 31. The top film sheet 14 is brought into contact with the bacon 12 and the bottom film sheet 16, and a vacuum is applied therebetween. A first permanent, hermetic seal 28, 38 is formed in the margins 25 and 35 of each product compartment 20 and 30. These outer seals 28, 38 surround each bacon portion 12*a*, 12*b* on three sides. The hermetic seals 28, 38 may be completely extended around the periphery of the product portions 12*a*, 12*b* by forming a second, inner peelable hermetic seal portion 29 and 39 in each product compartment interior of the recloseable seals 24, 34 and exterior of the bacon portions 12*a*, 12*b*. It is preferable that the inner hermetic seals 29, 39 are secure, yet peelable hermetic seals which maintain a secure seal during handling and storage that can be peeled back upon the application of digital forces applied through the two respective recloseable seals 24 and 34. The top film sheet 14 is then adhered to the attachment flange 50 of the recloseable seal assembly 40, thereby sealing the two bacon portions 12*a*, 12*b* into their respective product compartments 20 and 30.

Means for separating and gaining initial access to the recloseable seals 24, 34 of each individual product compartment is shown as a line of weakening 58, extending longitudinally through the package central web portion 18 between the recloseable seals 24 and 34 of the two bacon compartments. The line of weakening 58 will serve as a tamper evident feature which indicates prior access to the recloseable seals 24, 34. The line of weakening 58 can be administered in any suitable manner such as by perforations or scoring. Either one of the rib and groove closure members 44, 46 of the interengaging fastener assembly 42 may be provided with a colored layer 60 which is either coextruded with the closure member, such as the bottom groove closure member 46, or separately adhered thereto. The colored layer 60 serves to provide the package 10, with an attractive visual appearance after folding around the line of weakening 58. Additionally, a package label or other suitable package graphics (not shown) may also be applied in a conventional manner to the package central web portion 18. After assembly of the two film sheets 14 and 16, the two package compartments 20 and 30 may be folded onto each other about the line of weakening 58 and secured by a band or sleeve 64.

Another embodiment of a multiple compartment recloseable food product package 100 incorporating the principles of the present invention and having three bacon portions 112*a*, 112*b* and 112*c* is shown in FIG. 4. The basic structure of this embodiment is generally the same as that described in the first embodiment except that the package contains three individual food product compartments 120, 130 and 140, each having its own recloseable seal 124, 134 and 144. The package 100 has a bottom film sheet 116 which contains three separate product support areas 121, 131 and 141. A recloseable seal assembly is associated with each product compartment and includes a double fastener element assembly 160 located between the first and second product compartments 120, 130 and a single fastener element assembly 170 located between the second and third product compartments 130, 140. The individual rib and groove elements of the single fastener element assembly 170 applied to central web portion 172 may be provided with attachment flanges of sufficient width to effect a sufficiently strong bond between the fastener assembly 170 and the package films to ensure the integrity of the associated recloseable seal 144. These two fastener assemblies 160, 170 are adhered to the film sheets 114, 116 at two package central web portions 162 and 172 by way of their respective attachment flanges. Each package web portion 162, 172 has a line of weakening 164, 174 associated therewith.

A four portion alternative embodiment of a multi-compartment recloseable food product package 200 is shown in FIG. 5 as containing four individual food product portions 212*a–d* contained within four separate product compartments 220, 230, 240 and 250, each having its own recloseable seal 224, 234, 244 and 254. The four portion package 200 can be assembled from top and bottom film sheets 214, 216 which have substantially the same dimensions as the corresponding film sheets of the two portion package 10 and the three portion package 100 depicted in FIGS. 1–4 and discussed above. Consequently, the three and four portion packages 100 and 200 may be run on the same packaging machinery used for a two portion package 10 with only minimal modifications. In this manner, the same bacon amount normally contained in a single package is effectively split into four smaller, individual recloseable compartments which can be separated by the user by tearing along the lines of weakening 262, 264 and 266.

In assembling the four portion package 200 as shown, two recloseable seal assemblies 260, 270, which each have a double interengaging fastener assembly interconnected by integral, central webs are applied to the bottom film sheet 216. The four bacon portions are then deposited on the four bacon support areas 221, 231, 241 and 251 and the top film sheet 214 is contacted and bonded to the bottom film sheet 216, after the application of vacuum to form the four individual bacon compartments 220, 230, 240 and 250. Lines of weakening 262, 264 and 266 are then applied to the package web portions, and the package is subsequently folded upon itself in the web portions and along the lines of weakening and retained in the folded position by a band (not shown), if desired. The package 200 can be folded either in half or in an 'accordion' style along each of the web portions 217, 218 and 219.

Lastly, yet another embodiment of a package 300 incorporating the principles of the present invention is illustrated in FIGS. 6 and 7, as a two portion frankfurter package. The structural elements of this embodiment are virtually the same as those shown in FIGS. 1–3 such as the recloseable seals 301, 302 and their associated inner hermetic peel seals 310, 311, except for the differences in dimensions and shaping which are required to accommodate food products which are sausage-shaped.

During production of packages of the present invention, a continuous strip of the recloseable seal interengaged closure members 44, 46 may be fed and applied to the central web portion 18 of a continuous length of the bottom film sheet 16 and sealed thereto to adhere the recloseable seal continuous strip assembly to the bottom film sheet 16. The continuous strip assembly is preferably trimmed even with the desired edges of the bottom film sheet 16 and are attached together at their respective ends 80, 81 to form the eventual package mouth. Accordingly, there is no wasting of the recloseable seal strip material.

An individual bacon carrying package film sheet 14 may then be dimensioned and cut from the continuous length and transferred to a product application area. A preselected amount of bacon 12 or the like is then deposited thereon within the product support areas 21 and 31 to from a product film sheet assembly, which is subsequently transferred to a packaging station where the opposing film sheet 16 may be fed from supply rolls into a position opposite the product support areas 21, 31 of the product film sheet assembly and into contact therewith at the product compartment margins 25, 35.

The top film sheet 14 is then adhered to the interengaging fastener element faces 50, 52 and is bonded thereto at the outer hermetic seal areas thereof 28, 38 and if desired, at the inner hermetic seal areas 29, 39. When it is desired to open a finished package, the user grips the package compartments 20 and 30 and tears them apart along the line of weakening 58 to separate an individual portion package 20 and gain access to the recloseable seal 24. The excess material of the rib and groove closure members serves to provide pull flanges which are gripped by the user for applying digital pull apart forces thereto in order to open the recloseable seal of that compartment. The recloseable seal will separate and open, thereby allowing access to the inner bacon or the like. The recloseable seal fastener elements will open to form a product compartment mouth and because the recloseable seal is adhered to the package film sheets 14 and 16 and attached together at its ends, the likelihood of destruction of the integrity of the product compartment is greatly diminished.

It will be seen that while certain embodiments of the present invention have been shown and described, it will be obvious to those skilled in the art that changes and modifications may be made therein without departing from the true spirit of the scope of the invention.

We claim:

1. A recloseable package having two hermetically sealed separate product compartments arranged in side-by-side order, comprising, in combination:

a first flexible film sheet adapted to receive two distinct product portions thereon, the two distinct product portions being separated by a central web portion interposed therebetween;

continuous recloseable fastener means disposed on the central web portion of the first flexible film sheet, the continuous recloseable fastener means including two elongated interengaged fastener strips, the interengaged fastener strips being attached to said central web portion, the interengaged fastener strips being further attached together at the ends thereof to define two separate package mouth portions of the two separate product compartments;

a second flexible film sheet contacting and bonded to said first flexible film sheet around at least a portion of the perimeter of each of said two distinct product portions to form two hermetic seals between said first and second flexible film sheets, which hermetic seals completely surround said two separate product compartments, said continuous recloseable fastener means occupying the remainder of the perimeter of said two distinct product portions, the second film sheet further being attached to said continuous recloseable fastener means so as to form two recloseable seals at the two mouth portions of said two product compartments, each distinct product compartment having its own recloseable seal; and said central web portion of said package having means for separating said package into two, single product compartments including a line of weakening extending through said central web portion and being disposed on said central web portion between two of said recloseable seals, said first and second flexible film sheets being bonded together at said central web portion in a manner which allows said two separate product compartments to be folded over onto each other around a centerline of said central web portion, said central web portion having a preselected width extending between said two recloseable seals which allows said two separate product compartments to be folded upon each other without separation of said recloseable and hermetic seals and without separation of said two product compartments along said line of weakening; and, band means for encircling said two product compartments and holding the same together.

2. A method for enclosing multiple product portions between two package panels to form a single package having multiple product portions, the method comprising:

providing a first flexible package panel and a second flexible package panel;

providing a fastener strip assembly having two separate, generally parallel areas of interengaging fastener elements which are separated by interconnecting fastener strip assembly webs, the webs having a preselected width extending between said interengaging fastener elements;

attaching the fastener strip assembly to one of the first and second package panels to define multiple product portion areas on one of said first and second package panels, the fastener strip assembly having a package sealing flange disposed on opposite sides thereof;

placing a product onto said one of said first and second flexible package panels in adjacent discrete product portions in a manner such that each discrete product portion is separated from its adjacent discrete product portion by a central web portion having a preselected width to thereby form a product-backing assembly;

placing another of said first and second flexible package panels over the package panel assembly to form a package flexible covering panel;

sealing said first and second flexible package panels together in a manner so as to form individual hermetic seals between said first and second flexible package panels around the entire periphery of each of said multiple product portions to thereby provide each of said multiple product portions with its own distinct hermetic seal, and whereby each of said individual hermetic seals includes at least one peelable bond area interior of and adjacent said interengaging fastener elements;

attaching said package flexible covering panel to said interengaging fastener elements in a manner so as to form individual recloseable seals associated with said multiple product portions;

providing a line of weakening in said package central web portion between each of said multiple product portions and exterior of said individual recloseable seals associated with said multiple product portion;

folding said multiple product portions upon each other around a centerline of said central web portions to form a folded package assembly, said interconnecting fastener strip assembly web width having a dimension which thereby permits said multiple product portions to be folded upon each other without breaching said recloseable and hermetic seals and without separating said multiple product portions from each other along said line of weakening; and encircling said folded package assembly with band means.

3. The method of claim 2, further including adhering said interengaging fastener strip assembly to said first and second package panels by adhesive means.

4. The method of claim 2, further including vacuum-packing said product between said first and second package panels.

5. The method of claim 2, further including gas-flushing said discrete product portions.

6. The package of claim 1, wherein each product compartment includes a carrier sheet for supporting a preselected amount of product thereon within said product compartment.

* * * * *